US005379688A

United States Patent [19]

Ishii

[11] Patent Number: 5,379,688

[45] Date of Patent: Jan. 10, 1995

[54] METHOD OF AND APPARATUS FOR AUTOMATICALLY CONTROLLING PRESSING FORCE OF PRESS MACHINE

[76] Inventor: Mitishi Ishii, 1-3, Higashiohmichi 2-chome, Ohita-shi, Ohita, Japan

[21] Appl. No.: 90,152

[22] PCT Filed: Nov. 30, 1992

[86] PCT No.: PCT/JP92/01570

§ 371 Date: Jul. 28, 1993

§ 102(e) Date: Jul. 28, 1993

[87] PCT Pub. No.: WO93/10966

PCT Pub. Date: Jun. 10, 1993

[30] Foreign Application Priority Data

Dec. 3, 1991 [JP] Japan ..... 3-347921

[51] Int. Cl.[6] ..... B30B 13/00; B30B 15/26; B30B 15/14

[52] U.S. Cl. ..... 100/35; 100/43; 100/50; 100/99; 100/257

[58] Field of Search ..... 100/35, 43, 48, 50, 100/99, 257

[56] References Cited

U.S. PATENT DOCUMENTS 3,115,086 12/1963 Stimmel ..... 100/48

5,069,060 12/1991 Ishii ..... 72/443

FOREIGN PATENT DOCUMENTS 0353479 2/1990 European Pat. Off. .

0367035 5/1990 European Pat. Off. ..... 100/43

3228559 2/1983 Germany ..... 100/43

3241063 5/1984 Germany ..... 100/43

57-9600 1/1982 Japan ..... 100/43

63-180400 7/1988 Japan .

3-86395 4/1991 Japan ..... 100/99

3-33439 5/1991 Japan .

3-155499 7/1991 Japan .

*Primary Examiner*—Stephen F. Gerrity

*Attorney, Agent, or Firm*—Armstrong, Westerman, Hattori, McLeland & Naughton

[57] ABSTRACT

Pressing force with which a die tool presses on a workpiece is controlled so as to be constant at all times. The magnitude of pressing force with which the die tool presses on the workpiece during press working is detected with a semiconductor strain gauge (84), and the pressing force detected and a preset pressing force are compared with each other by a controller. If there is a difference between the pressing force detected and the preset pressing force, a screw rod (35) is turned by an AC servomotor (24) so as to adjust the length of a lower ram (60), thereby controlling the pressing force.

4 Claims, 5 Drawing Sheets

FIG. 5

| Mode | Contents |
|---|---|
| 00 | Detection of die abnormality |
| 01 | Basic time |
| 02 | Standard number of times of working |
| 03 | Upperlimit value of pressure |
| 04 | Lower limit value of pressure |
| 05 | Display of pressure |
| 06 | Setting of press working pressure |
| 07 | Setting of overpressure |
| 08 | ..... |
| 09 | ..... |

METHOD OF AND APPARATUS FOR AUTOMATICALLY CONTROLLING PRESSING FORCE OF PRESS MACHINE

TECHNICAL FIELD

The present invention relates to a method of and an apparatus for automatically controlling a pressing force of a press machine so that the pressing force with which a die tool presses on a workpiece, during a working process thereon, is maintained at a constant level, More particularly, the present invention relates to a method of and an apparatus for automatically controlling pressing force of a press machine, by which the pressure with which a die tool presses on a workpiece during press working can be set to a preset optimal working pressure.

BACKGROUND ART

Press working is known as a working method wherein a part or the whole of a metal or other material is plastically deformed by using a working machine, e.g., a press, which mainly performs a reciprocating compression motion, and a die tool, thereby effecting forming, assembling, parting, straightening, etc. In the press working, the press working pressure, which is used to cause a plastic deformation to a workpiece, changes with the progress of the working process and also with changes in the atmospheric temperature or other environmental conditions. Particularly, when fine plastic working (for example, fine blanking, fine cutting, etc.) is performed by the press working, nonuniformity of pressed products occurs shortly after the start of the working process and it becomes difficult to effect stable working.

This phenomenon is explained hereinafter in more detail. In the case of a mechanical press, even if it is produced from metallic materials all of which have the same coefficient of thermal expansion, a portion of the machine body which is frequently subjected to friction heats up, and this portion alone rises in temperature. Accordingly, only the heated portion expands. As a result, the elements constituting the press are deformed. In the case of a crank press machine, for example, if the machine body expands, the position of the bottom dead center, where the pressing force is the strongest, rises, which consequently requires a lowering in the pressing force. If the ram, which lies in the center, is heated alone, it expands, and the position of the bottom dead center lowers in reverse to the above, resulting in a rise in the pressing force.

Also, in the case of a hydraulic press a phenomenon similar to that in the case of the mechanical press occurs. That is, the temperature of oil used for hydraulic pressure rises as time elapses after the start of a working process, and the pressing force rises until an appropriate temperature is reached. However, when the temperature exceeds the appropriate level, the viscosity of the oil decreases, resulting in a lowering in the pressing force.

Thus, since the change of the pressing force causes nonuniformity of pressed products, the pressing force must always be adjusted in order to realize fine working. However, even if the pressing force is set to an optimal level at the beginning of a press working, if the working process is continued for a long time, the temperature rises, and the position where pressing is effected, that is, the position of the bottom dead center, changes, resulting in a change in the pressing force.

DISCLOSURE OF THE INVENTION

The present invention has been made with the above-described technical background, and it aims at attaining the following objects.

It is an object of the present invention to provide a method of and an apparatus for automatically controlling pressing force of a press machine so that the pressing force with which a die tool presses on a workpiece is always maintained at a constant level.

It is another object of the present invention to provide a method of and an apparatus for automatically controlling pressing force of a press machine, by which a change in the pressing force during press working is sensed and the pressing force is corrected for the change.

It is still another object of the present invention to provide a method of and an apparatus for automatically controlling pressing force of a press machine so as to prevent occurrence of a defective pressed product.

It is a further object of the present invention to provide a method of and an apparatus for automatically controlling pressing force of a press machine so as to prevent damage to a press die.

The present invention has an advantage in that since a press working operation can be performed with a constant pressure regardless of the configuration, thickness, etc. of the die used, no extra energy is used.

The present invention has another advantage in that since the pressing force is maintained at a constant level regardless of changes in temperature or other environmental conditions, stable press working can be realized.

In order to solve the above-described problems, the present invention adopts the following method of and the apparatus for automatically controlling pressing force of a press machine.

That is, the present invention provides a method of automatically controlling pressing force of a press machine in a cycle of press working where a part or the whole of a workpiece is plastically deformed by using the press machine and a die tool. The method includes the steps of:

- detecting the magnitude of pressing force with which the die tool presses on the workpiece during the press working;
- comparing the pressing force detected with a preset optimal pressing force; and
- correcting, if there is a difference between the pressing force detected and the preset pressing force, the pressing force so that it approaches the preset pressing force.

If the press working cycle is suspended when the pressing force exceeds a preset value, damage to the press die is prevented even more effectively.

In addition, the present invention provides an apparatus for automatically controlling pressing force of a press machine. The press machine includes:

- a frame;
- a ram movably provided on the frame and provided with a die tool;
- a ram driving mechanism for converting rotational motion into rectilinear motion to drive the ram rectilinearly; and
- a servomotor for driving the ram driving mechanism to rotate.

In the press machine, a part or the whole of a workpiece is plastically deformed by the die tool attached to the ram.

The control apparatus includes:

distance adjusting means provided on the ram for adjusting the distance between the workpiece and the ram;

a pressing force sensor provided on the press machine for detecting the magnitude of pressing force with which the die tool presses on the workpiece during press working; and a controller by which the magnitude of pressing force with which the die tool presses on the workpiece during the press working is detected with the pressing force sensor, and by which the pressing force detected and a preset pressing force are compared with each other, and if there a difference between the pressing force detected and the preset pressing force, the distance adjusting means is corrected so that the pressing force approaches the preset pressing force.

It will be more effective if the distance adjusting means includes:

a screw connecting mechanism that connects together the ram and the tool by a screw; and a screw driving servomotor for driving the screw connecting mechanism to adjust the above-described distance.

It is even more preferable to provide the pressing force sensor on the frame.

BRIEF DESCRIPTION OF THE DRAWINGS

FIG. 5 is a table showing mode numbers and setting contents, which are displayed by the control apparatus.

BEST MODE FOR CARRYING OUT THE INVENTION

Figure 1:
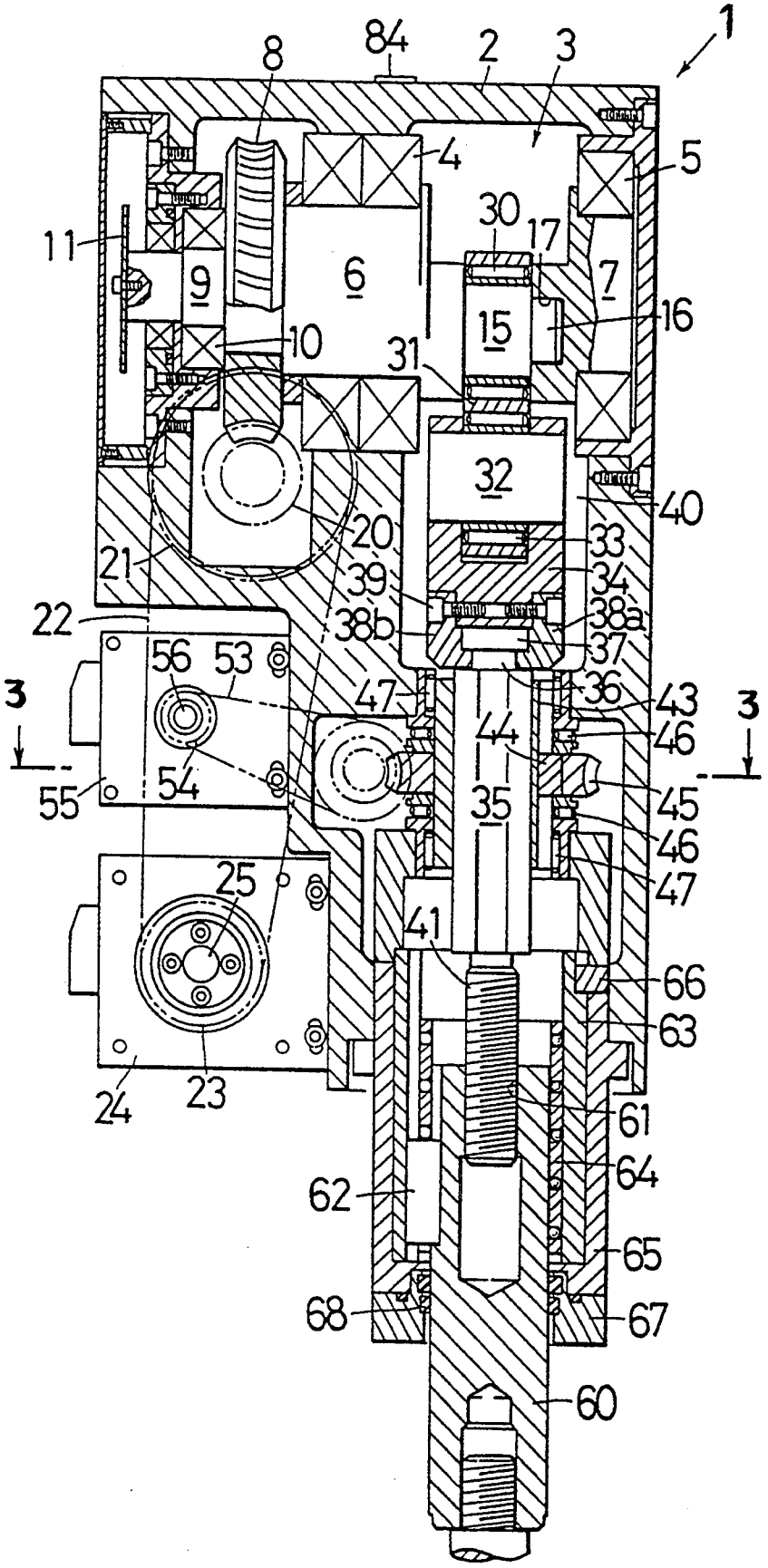
FIG. 1 is a sectional view of a press machine.
Figure 2:
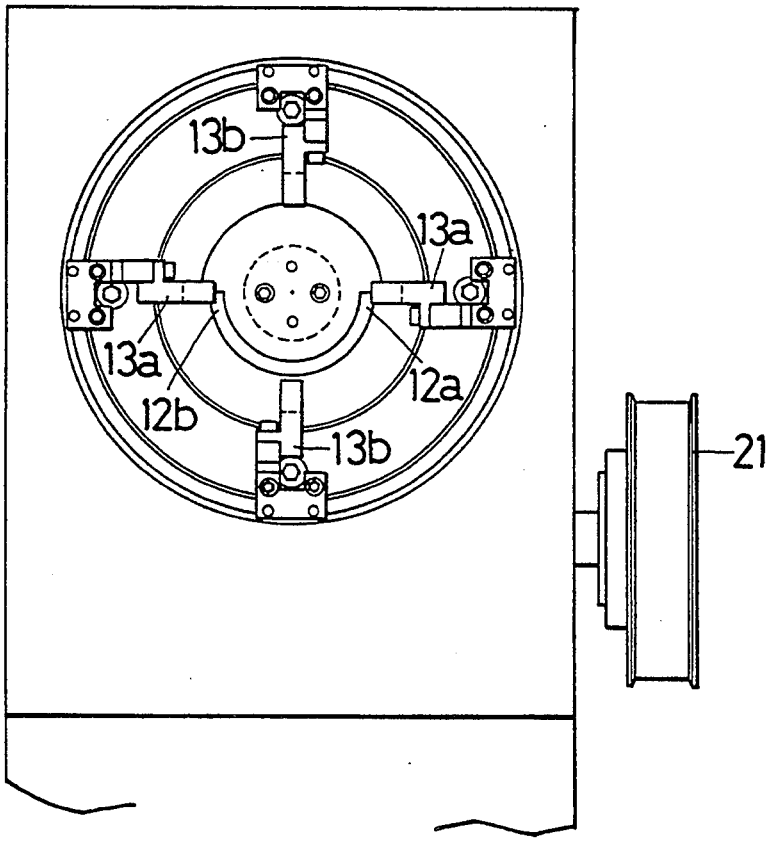
FIG. 2 is a side view of the press machine, shown in FIG. 1, as viewed from the left-hand side thereof.
Figure 3:
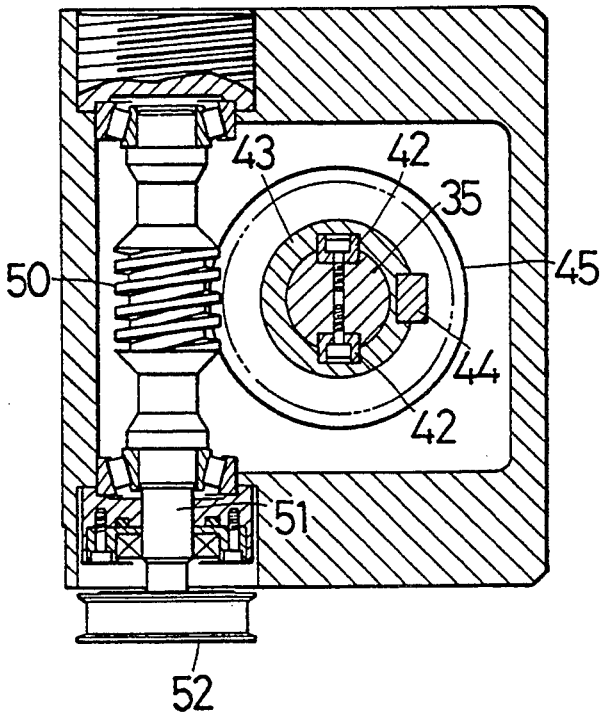
FIG. 3 is a sectional view taken along the line 3—3 in FIG. 1.

One embodiment of the present invention is now described below with reference to the accompanying drawings. FIG. 1 is a sectional view of a press machine 1. A frame 2 has an approximately box-shaped configuration. In this embodiment, the frame 2 is formed by casting. A crank mechanism 3 is incorporated in the frame 2. The crank mechanism 3 has crankshafts 6 and 7 supported by bearings 4 and 5, which, in turn, are supported by the frame 2 at two positions.

A worm wheel 8 is keyed to a shaft 9 extending from the crankshaft 6. Further, the shaft 9 is rotatably supported by the frame 2 through a bearing 10. A disc 11 is secured to one end of the shaft 9 for detecting the rotational speed of the crank mechanism 3. Notches 12*a* and 12*b* are formed on the outer periphery of the disc 11. The notches 12*a* and 12*b* are used for detection of the top and bottom dead centers of the crank mechanism 3 and formed at respective positions corresponding to the top and bottom dead centers. The top and bottom dead centers are detected by detecting the positions of the notches 12*a* and 12*b* by using four photosensors 13*a* and 13*b*.

The crankshaft 6 is integrally provided with a crank pin 15 which is disposed at an eccentric position on a crank arm extending from the crankshaft 6. The crank pin 15 has such a structure that it can be split into two at one end thereof. A connecting pin 16 is integrally provided on one end of the crank pin 15. The connecting pin 16 is inserted into a connecting hole 17 provided in the crankshaft 7. The central axis of the crank pin 15 is eccentric with respect to the mutual central axis of the crankshafts 6 and 7. Accordingly, the travel of the reciprocating ram 60 is about double the eccentricity.

On the other hand, the worm wheel 8 is in mesh with a worm 20. The worm 20 is retained by a shaft, which is further provided with a timing pulley 21. The timing pulley 21 is engaged with a timing belt 22. The timing belt 22 is in engagement with another timing pulley 23. The timing pulley 23 is connected to an output shaft 25 of an AC servomotor 24. Thus, the crank mechanism 3 is driven to rotate by the AC servomotor 24 through the output shaft 25, the timing pulley 23, the timing belt 22, the timing pulley 21, the worm 20 and the worm wheel 8.

One end of a connecting rod 31 is rotatably supported by the crank pin 15 through a crank pin bearing 30. On the other hand, the other end of the connecting rod 31 has a ram pin 32 rotatably provided thereon through a ram pin bearing 33. The ram pin 32 is secured to an upper ram 34. The upper end of a screw rod 35 is rotatably supported by the upper ram 34. The upper part of the screw rod 35 is integrally formed with a reduced-diameter portion 36 and a flange 37. The reduced-diameter portion 36 and the flange 37 are rotatably retained by two support members 38*a* and 38*b* which are in the form of a split support member.

The support members 38*a* and 38*b* are secured to the upper ram 34 by using bolts 39. The upper ram 34 is vertically movably supported through a linear bearing (not shown) in a ram space 40 formed in the frame 2. The lower end of the screw rod 35 is formed with an external thread 41. Two keys 42 are secured to the outer periphery of the screw rod 35 by using screws. The keys 42 and a screw driving cylinder 43 are slidable only in the axial direction. In other words, the screw rod 35 and the screw driving cylinder 43 are connected together such that they are slidable only in the axial direction.

A key 44 is secured to the outer periphery of the screw driving cylinder 43. Further, a worm wheel 45 is secured to the outer periphery of the screw driving cylinder 43. Accordingly, the rotation of the worm wheel 45 is transmitted to the screw driving cylinder 43 through the key 44. Both sides of the worm wheel 45 are rotatably supported by the frame 2 through two thrust bearings 46. Further, the screw driving cylinder 43 is rotatably supported by the frame 2 through radial bearings 47.

The worm wheel 45 is meshed with a worm 50. A timing pulley 52 is connected and secured to a shaft 51 of the worm 50. The timing pulley 52 is engaged with a timing belt 53. Further, the timing belt. 53 is in engagement with another timing pulley 54. The timing pulley 54 is connected and secured to one end of an output shaft 56 of an AC servomotor 55. Thus, the AC servomotor 55 drives the screw rod 35 to rotate through the output shaft 56, the timing pulley 54, the timing belt 53, the timing pulley 52, the shaft 51, the worm 50, the worm wheel 45 and the screw driving cylinder 43.

The screw rod 35 is screwed into an internal thread 61 formed in the upper end of a lower ram 60. The lower ram 60 is vertically slidably supported by a cylindrical guide bush 63 through a sliding key 62. A ball guide 64 is interposed between the guide bush 63 and the lower ram 60. Further, the guide bush 63 is inserted into an outer casing 65.

The outer casing 65 and the guide bush 63 are secured to each other by a locking key 66 so as not to rotate relative to each other. The outer casing 65 is further secured to the frame 2 by using bolts. A lid 67 is secured to the lower end of the outer casing 66 by using bolts. Since the inside of the frame 2 is filled with oil, the lid 67 is provided with an oil seal 68 to seal the area between the lid 67 and the lower ram 60 to thereby prevent leakage of oil.

Control Apparatus 70

Figure 4:
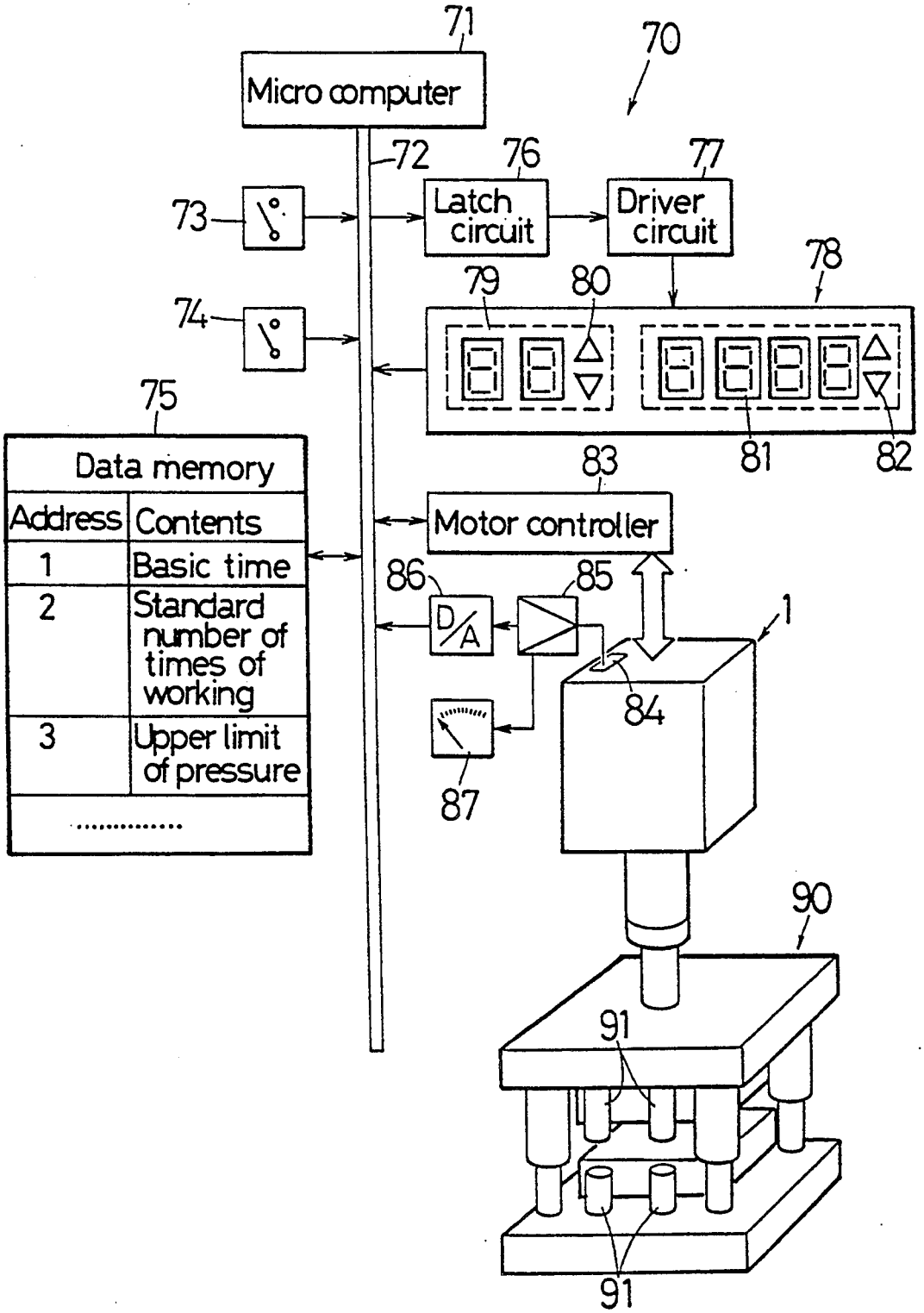
FIG. 4 is a functional block diagram of a control apparatus.

FIG. 4 is a functional block diagram roughly showing a control apparatus used for the press machine. The control apparatus 70 controls the operation of the press machine. A microcomputer 71 is one which is well known as a one-chip microcomputer. The microcomputer 71 is connected with an initial switch 73 via a bus 72. The initial switch 73 is used to set initial conditions to the control apparatus 70.

A start switch 74 is used to start the operation of the press machine when working process is to be carried out. A data memory 75 is a memory for storing various kinds of data, for example, set values for the upper and lower limits of pressure used as working pressure during press working process. The press machine is operated within the upper and lower limits. Further, the data memory 75 can be stored with a basic time, a standard number of times of working, etc. as set data.

A control panel 78 includes LED displays and input switches. A two-digit LED display 79 displays a mode number. A mode select switch 80 is a digital switch used to select an operating mode of the control apparatus. A four-digit LED display 81 is used to display data. A numeral setting switch 82 is a digital switch used to input numerical values to be set to the LED display 81.

Since the microcomputer 71 transfers data to the LED displays 79 and 81 only when the display data is changed, a latch circuit 76 is provided for holding display data transferred. The data is displayed through a driver circuit 77. A motor controller 83 is a controller composed mainly of a relay circuit for controlling the AC servomotors 24 and 55 so that these servomotors rotate forwardly and backwardly and stop in response to commands.

In the meantime, a semiconductor strain gauge 84 is attached to the topmost part of the frame 2. The semiconductor strain gauge 84 is a device with a resistance thereof which changes when the semiconductor is strained. The semiconductor strain gauge 84 detects deformation of the frame 2 to thereby detect a pressure applied to the workpiece. The output of the semiconductor strain gauge 84 is applied to the microcomputer 71 through an amplifier 85 and a D/A converter 86 so that data on the pressure is constantly monitored by the microcomputer 71. A meter 87 displays analog data on the working pressure applied to a die 90 from the lower ram 60.

Setting of Initial Values

In advance of the start of a press operation, the following contents are set in the data memory 75 of the control apparatus: basic time, a standard number of times of working, an upper limit of pressure, a lower limit of pressure, a set value for press working pressure, and a set value for overpressure. These initial values are set by inputting necessary data using the digital switch 81 after a desired mode has been selected with the mode select switch 80. FIG. 5 is a table showing the relationship between mode numbers and the contents.

The mode 01 shows basic time. The basic time is a period of time set with regard to circumstances where the die may be damaged or abnormally worn out in a relatively short time. The mode 02 shows a standard number of times of working. This is a number of times of working set with regard to circumstances where the die may be abnormally worn out or damaged at a relatively small number of times of working. A punch and a female die, which serve as die tools, wear because the workpiece slide on the surfaces of these tools during working. In other words, the edges of the tools gradually wear at the surfaces thereof for each working process.

When the wear normally progresses, there is no rapid change in the press working pressure. Therefore, no problem arises. It is known that when the wear progresses normally, the pressing force increases gradually. However, if the die has become abnormally worn or broken for some reason, a large change occurs in the press working pressure in a relatively short time or at a relatively small number of times of working. In other words, the derivative of the press working pressure with respect to the time or the number of times of working increases. Thus, for the basic time and the standard number of times of working, values obtained experimentally or empirically on the basis of the above-described finding are set in advance.

The press working pressure somewhat varies in a pair of successive cycles even during a normal operation. The mode 03 shows an upper limit value of the pressure. This is the upper limit value of the pressure allowed within the basic time and the standard number of times of working. The mode 04 shows a lower limit value of the pressure. This is the lower limit value of the pressure allowed within the basic time and the standard number of times of working. For the upper and lower limit values of the pressure, values obtained experimentally or empirically on the basis of the above-described finding are set in the same way as in the above.

When the mode 05 is selected, a pressure display mode is set. In the pressure display mode, a pressure actually applied is displayed. When the mode 06 is selected, a press working pressure setting mode is set. In the press working pressure setting mode, a level of pressure for working is set. Even during normal working process, if the press working pressure varies in a wide range, a certain variability range may be set.

The mode 07 is an overpressure setting mode. In the overpressure setting mode, a limit value of the press working pressure beyond which the press operation is suspended is set. For the above-described upper and lower limit values of the pressure, values corresponding to amounts of change in the pressure within a relatively short time and a relatively small number of times of working are set. However, for the overpressure, not an amount of change in the press working pressure but an absolute value of the press working pressure is set. If the press working pressure exceeds the set value of the overpressure, the press is immediately suspended.

Operation

Figure 6:
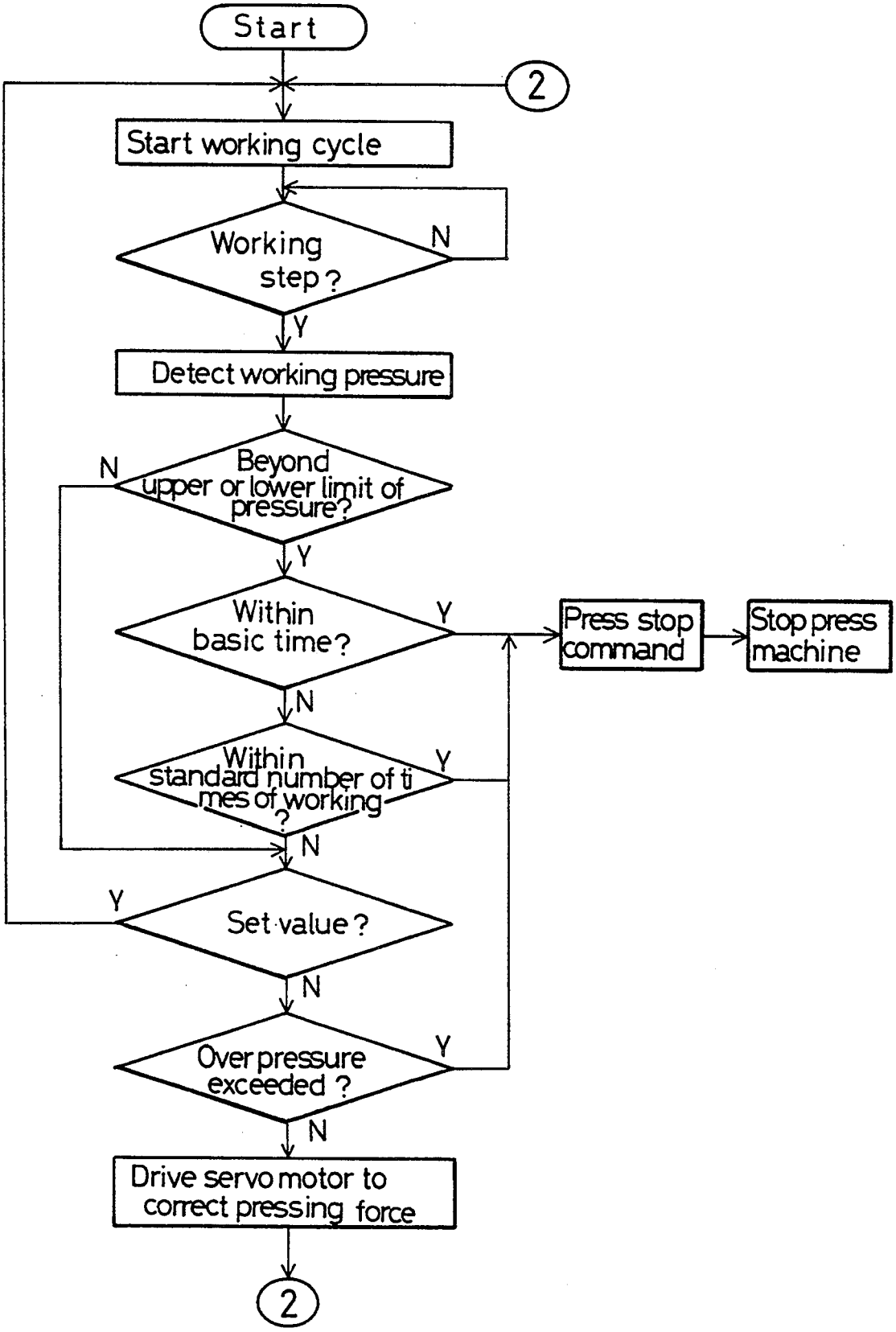
FIG. 6 is a flowchart roughly showing the operation of the control apparatus during working process.

FIG. 6 is a flowchart roughly showing the operation of the control apparatus. Before the start of the operation, the following initialization is made. When the initial switch 73 is pressed, the AC servomotor 24 is started, and the crank mechanism 3 is driven. In response to the drive of the crank mechanism 3, the lower ram 60 begins lowering. The lowering of the lower ram 60 by the crank mechanism 3 is stopped at the bottom dead center by the sensing operation of the photosensors 13*a*. Next, the AC servomotor 55 is started to drive the screw rod 35.

The screw rod 35 drives the lower ram 60 to move downward. The lowering or moving downward of the lower ram 60 causes the stoppers 91*a* and 91*b* of the die 90 to collide with each other. The semiconductor strain gauge 84 detects the collision and suspends the AC servomotor 55. This position is the origin where working is started. The AC servomotor 24 is restarted to drive the crank mechanism 3 so as to lift the lower ram 60. The lower ram 60 is stopped at the top dead center. Thereafter, the AC servomotor 55 is driven to lower the lower ram 60 by an amount corresponding to a numerical value predetermined by design. Thus, the initial setting is completed.

Next, when the start switch 74 is pressed, a working cycle is started. When the control apparatus 70 confirms that a workpiece has been placed on the die 90, the microcomputer 71 outputs a command to the motor controller 83 to start the AC servomotor 24. When the AC servomotor 24 is started, the crank mechanism 3 is driven in order to lower the lower ram 60.

The control of the speed of the AC servomotor 24 during this process may be affected by a known method proposed by the present inventor (see, Japanese Patent Application Post-Exam Publication No. 3-33439). In one cycle during this working process, when a working step (that is, a step of working the workpiece) is reached, the microcomputer 71 reads the press working pressure from the semiconductor strain gauge 84 and compares it with the pressure in the preceding cycle in order to decide whether or not a change in the detected working pressure is within the above-described upper and lower limits of the pressure.

If the change in the working pressure is judged to be beyond the upper or lower limit of the pressure, the microcomputer 71 immediately judges whether or not the change in the pressure has occurred within the basic time or the standard number of times of working. If it has occurred within the basic time or the standard number of times of working, the microcomputer 71 immediately commands the AC servomotor 24 to make an emergency halt. Further, the microcomputer 71 judges whether or not the pressure detected is within the set overpressure (i.e., absolute value). If the pressure detected is within the set pressure, the above-described working cycle is repeated. If the pressure detected exceeds the set overpressure, the microcomputer 71 immediately commands the motor controller 83 to suspend the AC servomotor 24.

If the pressure detected is not in excess of the set overpressure and shows that no correction is needed, the AC servomotor 55 is driven so as to move the lower ram 60 vertically to thereby adjust the pressing force. At this time, the lower ram 60 is vertically moved by driving the AC servomotor 55 to rotate a preset number of revolutions in accordance with the size of the difference between the set pressure and the detected pressure.

Other Embodiments

Although in the foregoing embodiment the present invention is applied to a press machine having a crank mechanism, it will be understood from the contents of the above description that the present invention is also applicable to other types of mechanical press (e.g., cam press, screw press, link press, rack-and-pinion press, knuckle joint press, etc.). The present invention is also applicable to hydraulic presses.

While the invention has been particularly shown and described in reference to preferred embodiments thereof, it will be understood by those skilled in the art that changes in form and details may be made therein without departing from the spirit and scope of the invention.

What is claimed is:

1. A method of automatically controlling pressing force of a press machine in a press working cycle wherein at least a part of a workpiece is plastically deformed by using said press machine and a die tool, said method comprising the steps of:

detecting a magnitude of pressing force with which said die tool presses on said workpiece during said press working;

comparing said pressing force detected with a preset optimal pressing force;

correcting, if there is a difference between a detected pressing force and a preset pressing force, said pressing force for said difference so that said detected pressing force approaches said preset pressing force; and suspending said press working cycle when said pressing force exceeds an upper or a lower limit of a preset value, and within a basis time upon which a period of time is set or within a working period which is set with regard to abnormal circumstances.

2. An apparatus for automatically controlling pressing force of a press machine having a frame, a ram movably operably coupled to said frame and provided with a die tool, a ram driving means, operably coupled to said ram, for converting rotational motion into rectilinear motion to drive said ram rectilinearly, and a servomotor means, operably coupled to said ram driving means, for driving said ram driving means to rotate, wherein at least a part of a workpiece is plastically deformed by the die tool attached to said ram, said apparatus comprising:

distance adjusting means, operably coupled to said ram, for adjusting a distance between said workpiece and said ram;

a pressing force sensor means, operably coupled to said press machine, for detecting a magnitude of pressing force with which said die tool presses on said workpiece during press working;

a data memory means memorizing a basic time upon which a period of time is set, a preset time of a working period, and one of an upper limit and a lower limit of a preset pressure; and a controller means for controlling a magnitude of pressing force with which said die tool presses on said workpiece during said press working based on a pressing force detected by said pressing force sensor, and for comparing said detected pressing force and a preset pressing force with each other, wherein if there is a difference between said pressing force detected and said preset pressing force, said controller means controls said distance adjusting means so as to correct said detected pressing force so that the detected pressing force approaches said preset pressing force, wherein said controller means suspends said press working cycle when said pressing force exceeds one of an upper limit and a lower limit of a preset value, and within a basic time upon which a period of time is set or within a working period which is set with regard to abnormal circumstances.

3. A control apparatus according to claim 2, wherein said distance adjusting means comprises:

a screw connecting mechanism that connects together said ram and said tool by a screw; and a screw driving servomotor for driving said screw connecting mechanism to adjust said distance.

4. A control apparatus according to claim 3, wherein said pressing force sensor is provided on said frame.

* * * * *